US007896184B2

(12) United States Patent
Meers

(10) Patent No.: US 7,896,184 B2
(45) Date of Patent: Mar. 1, 2011

(54) CRATE WITH COLLAPSIBLE WALL

(75) Inventor: Ryan C. Meers, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 382 days.

(21) Appl. No.: 11/945,172

(22) Filed: Nov. 26, 2007

(65) Prior Publication Data

US 2009/0134157 A1 May 28, 2009

(51) Int. Cl.
*B65D 6/00* (2006.01)
*B65D 8/14* (2006.01)
*B65D 90/02* (2006.01)

(52) U.S. Cl. ..... 220/7; 220/4.28; 220/6; 220/666; 206/600

(58) Field of Classification Search ..... 220/1.5, 220/4.28, 6, 7, 666; 206/386, 600
See application file for complete search history.

(56) References Cited

U.S. PATENT DOCUMENTS

| | | | |
|---|---|---|---|
| 3,835,792 | A | 9/1974 | Wharton |
| 3,981,410 | A | 9/1976 | Schurch |
| 4,406,380 | A | 9/1983 | Paige |
| 4,662,532 | A | 5/1987 | Anderson et al. |
| 4,674,647 | A | 6/1987 | Gyenge |
| 4,765,480 | A | 8/1988 | Malmanger |
| 5,016,772 | A | 5/1991 | Wilk |
| 5,161,709 | A | 11/1992 | Oestreich, Jr. |
| 6,015,056 | A | 1/2000 | Overholt et al. |
| 6,098,827 | A | 8/2000 | Overholt et al. |
| 6,209,742 | B1 | 4/2001 | Overholt et al. |
| 6,290,081 | B1 | 9/2001 | Merey |
| 6,305,566 | B1 | 10/2001 | Pigott |
| 6,601,724 | B1 | 8/2003 | Koefelda et al. |
| 6,918,502 | B1 | 7/2005 | Overholt et al. |
| 7,011,225 | B2 | 3/2006 | Oster et al. |
| 7,264,122 | B2 | 9/2007 | Koefelda et al. |
| 2002/0070215 | A1 | 6/2002 | Walsh et al. |
| 2003/0000950 | A1 | 1/2003 | Murakami et al. |
| 2004/0020821 | A1 * | 2/2004 | Koefelda et al. ..... 206/600 |

(Continued)

FOREIGN PATENT DOCUMENTS

| | | |
|---|---|---|
| CH | 456 438 | 7/1968 |

(Continued)

OTHER PUBLICATIONS

European Search Report for EP Application No. 08252850.6, Dec. 16, 2008.

(Continued)

*Primary Examiner* — Anthony Stashick
*Assistant Examiner* — Madison L Wright
(74) *Attorney, Agent, or Firm* — Carlson, Gaskey & Olds

(57) ABSTRACT

A crate, such as for transporting egg cartons or other items, includes a base, opposed side walls and a rear wall extending upward from the base. A front wall opposite the rear wall is selectably moveable between a closed position and a retracted, open position. In the retracted position, access to the interior of the crate is provided. The front wall includes an upper section pivotable relative to a lower section. At least one of the adjacent edges of the upper section and the lower section is contoured away from the other when the upper section is in the closed position. The contoured edge provides improved access to the interior of the container when the upper section is in the retracted position.

30 Claims, 14 Drawing Sheets

U.S. PATENT DOCUMENTS

| | | | | |
|---|---|---|---|---|
| 2004/0200833 | A1 | 10/2004 | Dubois et al. | |
| 2006/0231555 | A1 | 10/2006 | Smyers et al. | |
| 2006/0260976 | A1 | 11/2006 | Apps | |
| 2007/0158345 | A1 * | 7/2007 | Booth et al. | 220/6 |

FOREIGN PATENT DOCUMENTS

| | | | |
|---|---|---|---|
| DE | 35 00 427 | A1 | 7/1986 |
| DE | 92 03 114 | | 5/1992 |
| DE | 93 05 904 | | 8/1993 |
| DE | 201 01 630 | U1 | 4/2001 |
| EP | 0690003 | | 1/1996 |
| EP | 0 785 142 | | 7/1997 |
| EP | 1 225 131 | | 7/2002 |
| EP | 1 524 170 | A2 | 4/2005 |
| FR | 1227059 | | 6/1959 |
| GB | 2 357 078 | | 6/2001 |
| GB | 2 360 762 | | 10/2001 |
| GB | 2 431 922 | | 5/2007 |
| GB | 2 449 502 | | 11/2008 |
| JP | 2007-76655 | | 3/2007 |
| WO | 95/21773 | | 8/1995 |
| WO | 98/40199 | | 9/1998 |
| WO | 03/008275 | A2 | 1/2003 |
| WO | 2006/010311 | | 2/2006 |
| WO | 2008/145977 | A1 | 12/2008 |

OTHER PUBLICATIONS

European Search Report for EP Application No. 08170006.4, Mar. 27, 2009.

European Search Report for European Application No. 07254779.7, Apr. 11, 2008.

* cited by examiner

CRATE WITH COLLAPSIBLE WALL

BACKGROUND OF THE INVENTION

The present invention relates generally to containers and more particularly to a crate that is particularly useful for transporting egg cartons or other items to a store.

Currently, egg cartons are shipped to stores in metal crates. The crates must be unloaded onto shelves for the customers to select and purchase. This requires labor for handling the egg cartons in the store. The metal crates are expensive and are damaged easily. They are also subject to rust and are not recyclable. They are also not easily repairable.

SUMMARY OF THE INVENTION

The present invention provides a crate or container, such as for transporting egg cartons or other items. The crate includes a base, opposed side walls and a rear wall extending upward from the base. A front wall opposite the rear wall includes an upper section and a lower section. The upper section is selectably pivotable between a closed position and a retracted, open position. In the retracted position, access to the interior of the crate is provided. The upper section and the lower section each include edges adjacent one another. At least one of the adjacent edges is contoured away from the other edge when the upper section is in the closed position. The contoured edge provides improved access to the interior of the container when the upper section is in the retracted position.

In use, egg cartons (or other items) would be shipped to a store in the crate with the upper section of the front wall closed. At the store, the upper section of the front wall would be retracted to provide access to the egg cartons in the interior of the crate by customers or by store workers. The empty crate can then be returned to be reused in shipping additional egg cartons.

These and other features of the present invention can be best understood from the following specification and drawings, the following of which is a brief description.

DETAILED DESCRIPTION OF THE PREFERRED EMBODIMENT

Figure 1:
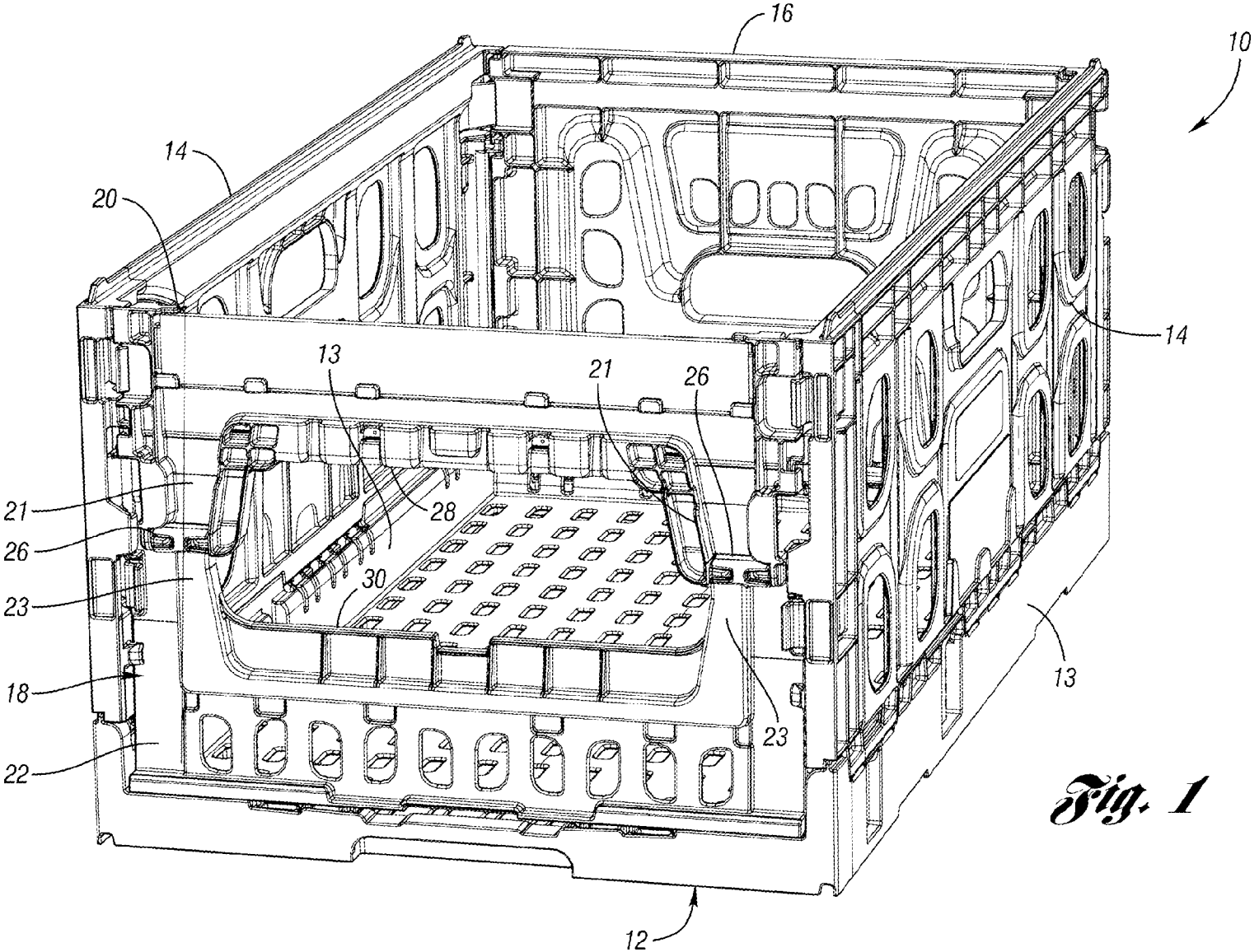
FIG. 1 is a front perspective view of a crate according to a first embodiment of the present invention.

A crate 10, such as for transporting egg cartons or other items, according to one embodiment of the present invention is shown in FIG. 1. The crate 10 includes a base 12 having integrally molded upstanding portions 13 to which are hingably connected side walls 14. A rear wall 16 is also hingably connected to the base 12 and latched to the side walls 14.

The front wall 18 includes an upper section 20 having a pair of downwardly extending arms 21 and a lower section 22 having a pair of upwardly extending arms 23. The arms 21 of the upper section 20 are connected to arms 23 of the lower section 22 by hinges 26. Between the arms 21 of the upper section 20 is an upper opening 28, which is also defined by a contoured lower edge of the upper section 20. Between the arms 23 of the lower section 22 is a lower opening 30, which is also defined by a contoured upper edge of the lower section 22.

Figure 2:
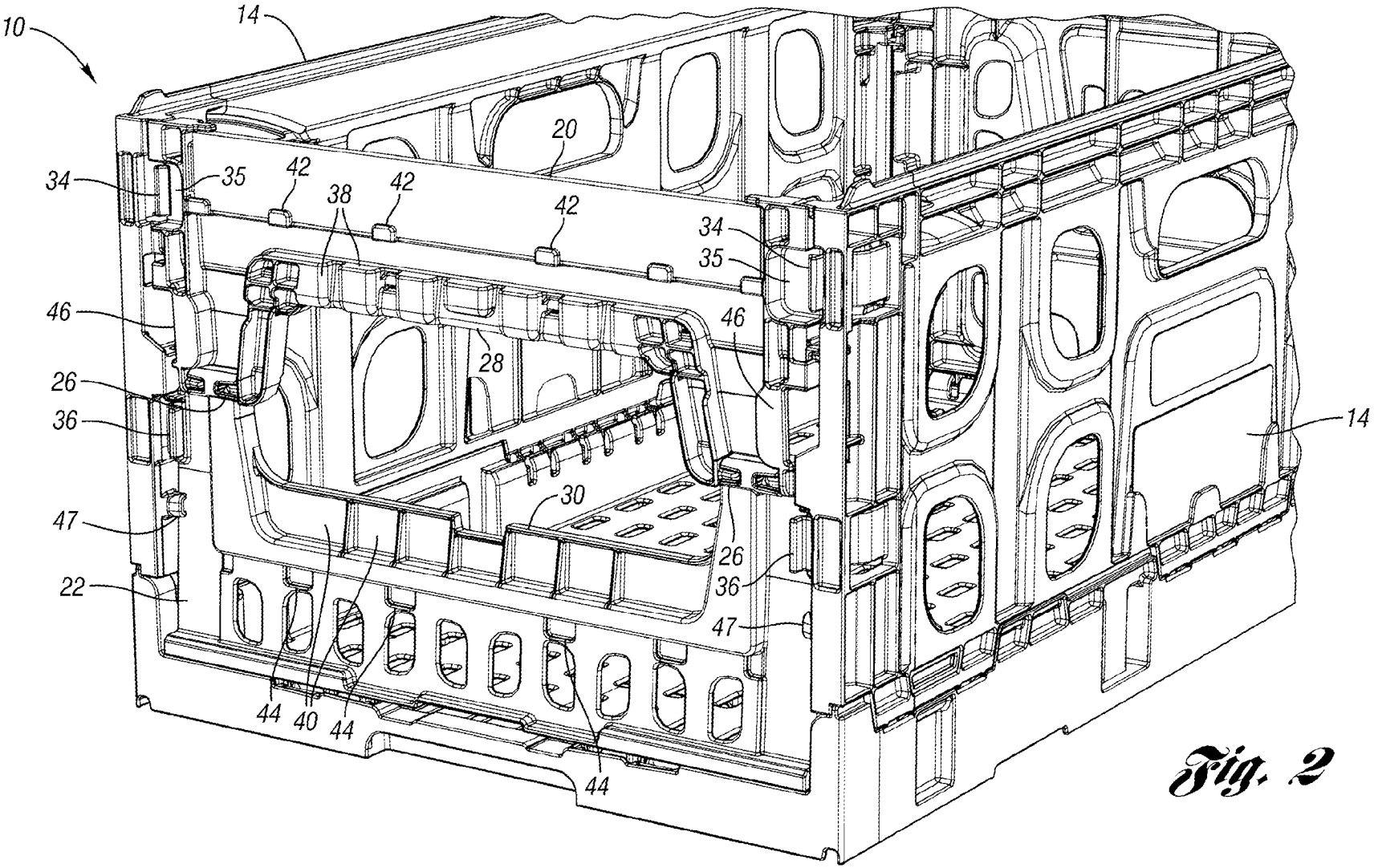
FIG. 2 is an enlarged view of the front of the crate of FIG. 1.

FIG. 2 is an enlarged perspective view of the front of the crate 10. The side walls 14 each include upper latches 34 adjacent latch plates 35 on the upper section 20. The side walls 14 further each include lower latches 36 adjacent the lower section 22. The upper section 20 includes a plurality of protrusions, such as protrusions 38 and protrusions 42 that correspond to recesses 40 and recesses 44 on the lower section 22. The upper section 20 includes a pair of latch plates 46 below the latch plates 35. While the latch plates 35 are positioned toward the interior surface of the upper section 20, the latch plates 46 are positioned toward the exterior surface of the upper section 20. Stops 47 protruding inwardly from the side walls 14 prevent the lower section 22 from pivoting forward (or outward).

Figure 3:
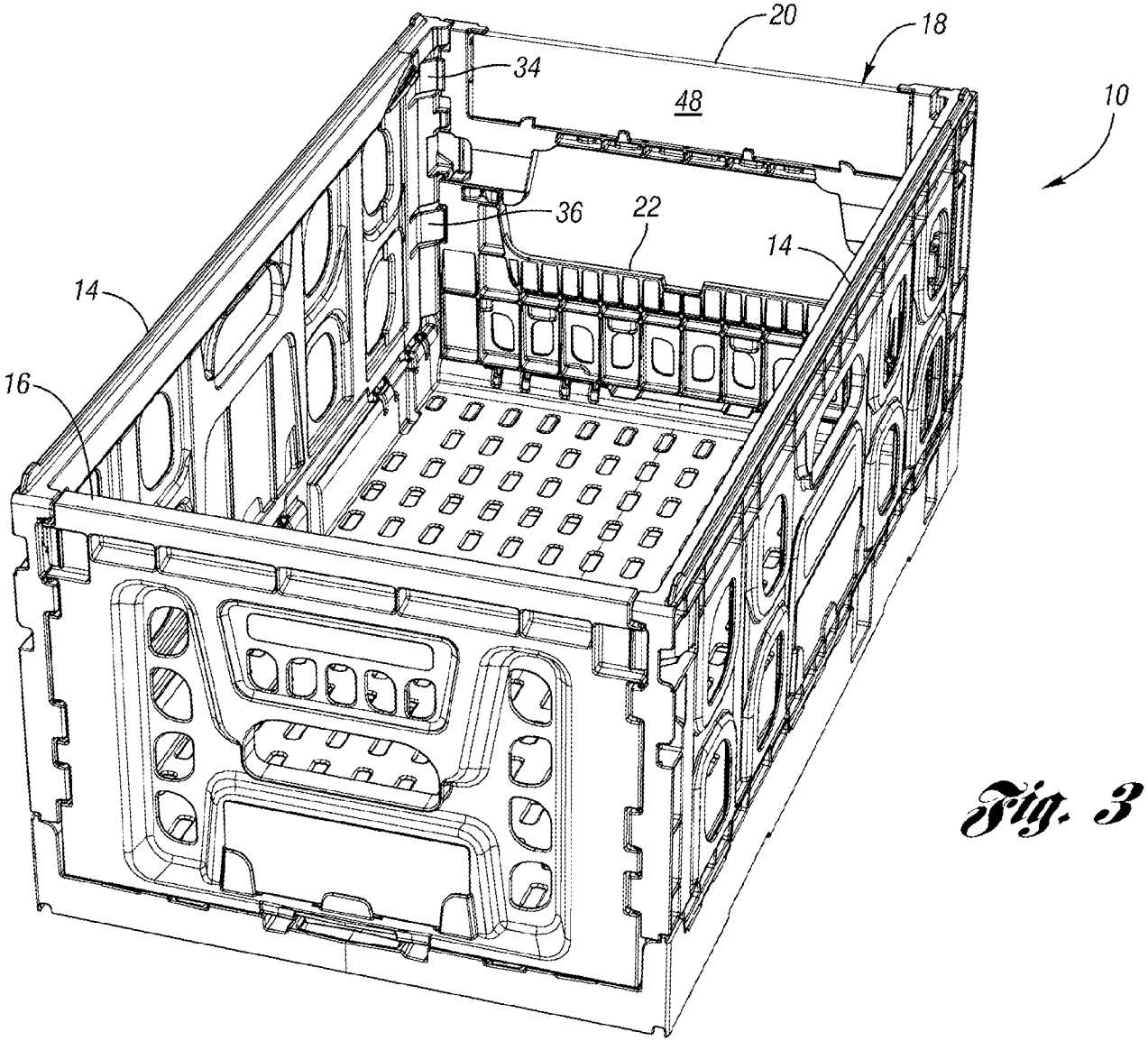
FIG. 3 is a rear perspective view of the front of the crate of FIG. 1.

FIG. 3 is a rear perspective view of the crate 10. The rear surface of the upper section 20 includes a label surface 48 on which logos can be applied by labels or could be molded into the upper section 20. The latches 36 selectively prevent the lower section 22 from pivoting into the interior of the crate 10.

Figure 4:
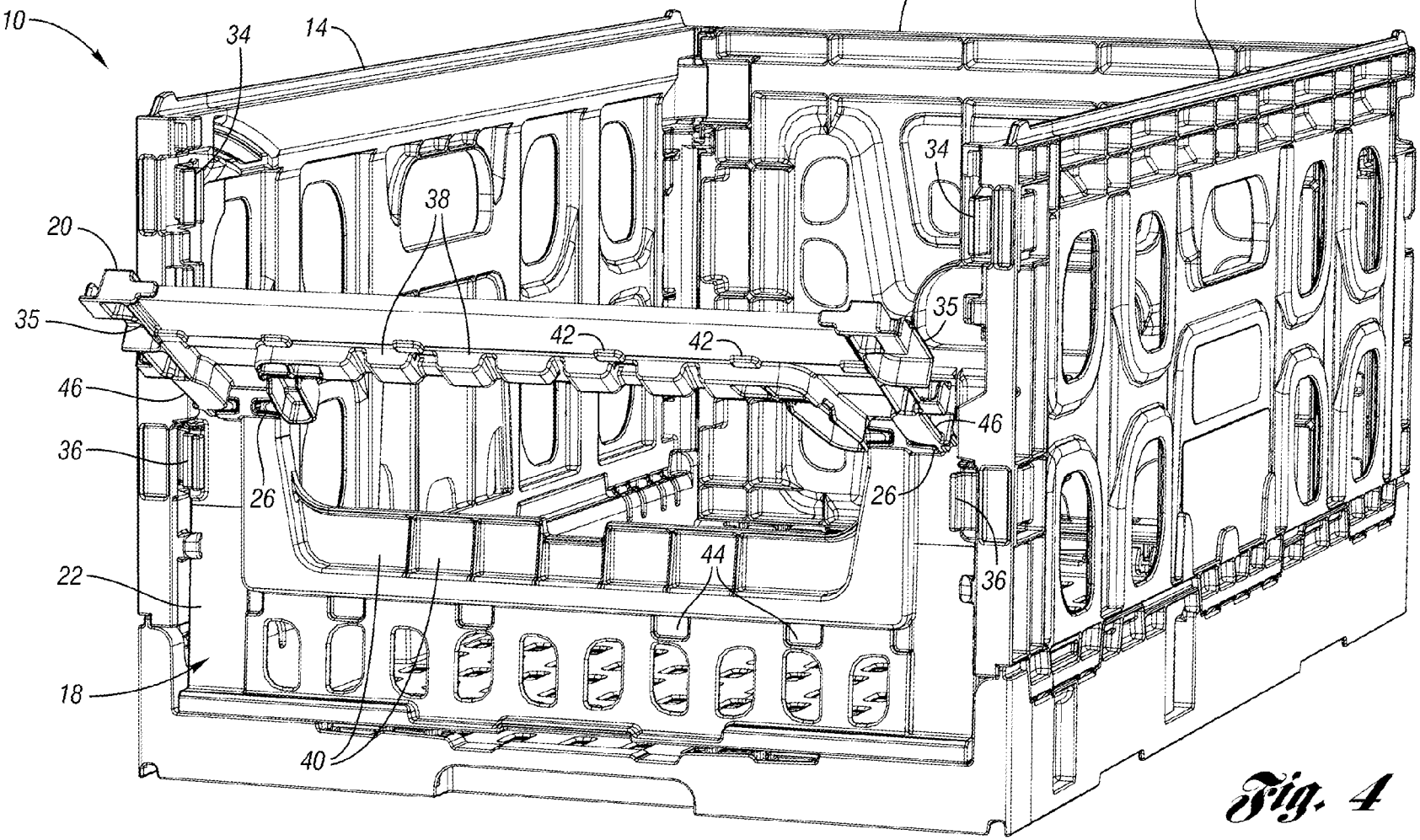
FIG. 4 shows the crate of FIG. 1 with the front wall being retracted.

FIG. 4 is a front view of the crate 10, with the upper section 20 being pivoted forward relative to the lower section 22 and relative to the side walls 14. After releasing the upper latches 34, the upper section 20 is pivoted forward (or outward of the crate 10) on the hinges 26. As shown, the protrusions 38, 42 of the upper section 20 are aligned with the recesses 40, 44 of the lower section 22 about the axis of hinges 26. Further, the latch plates 46 are generally aligned with the lower latches 36 about the axis of the hinges 26.

Figure 5:
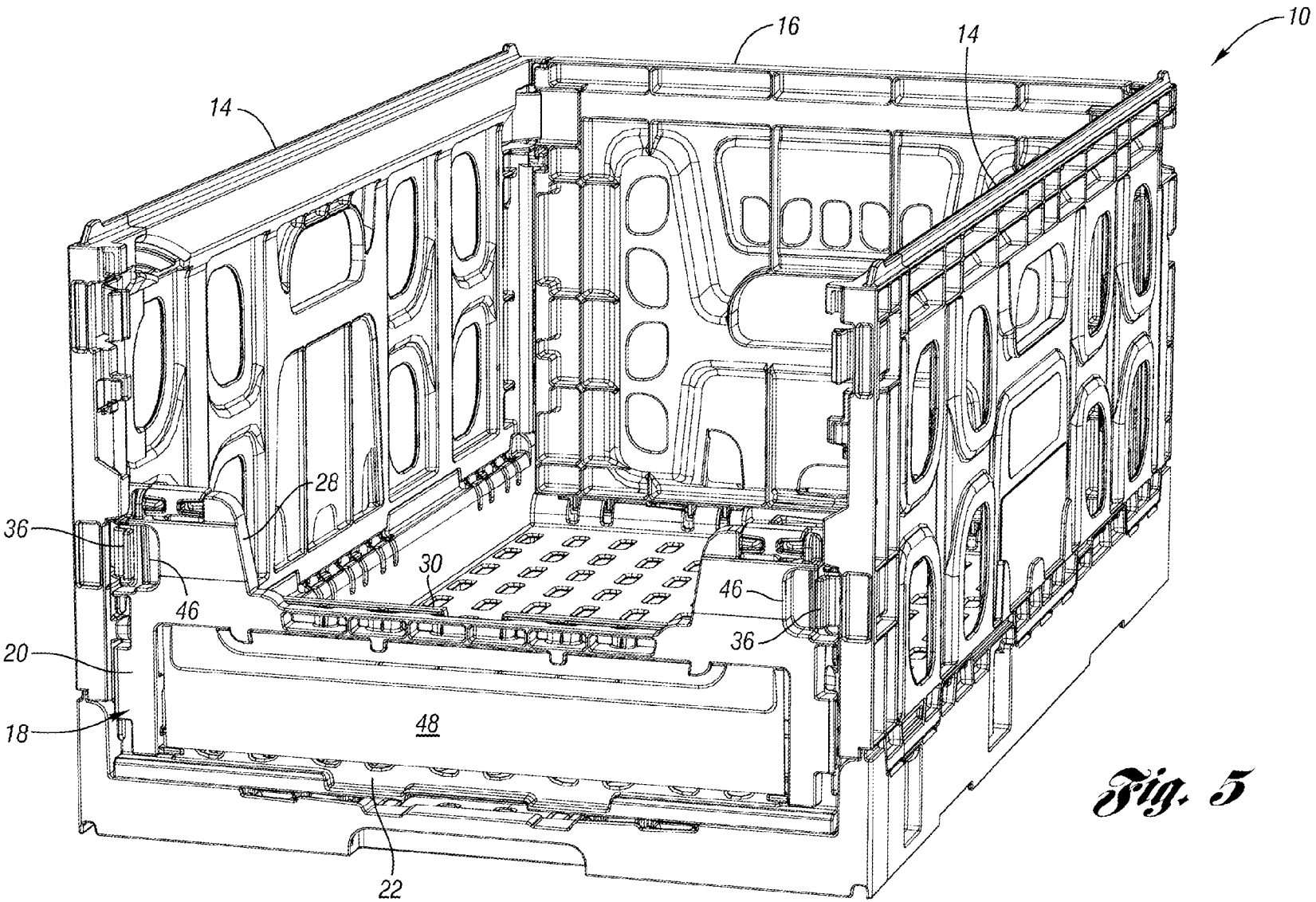
FIG. 5 shows the crate of FIG. 4 with the front wall retracted.

When the upper section 20 is pivoted down to a position abutting the lower section 22, as shown in FIG. 5, the protrusions 38, 42 of the upper section 20 are received in the recesses 40, 44 of the lower section 22. Optionally, the latch plates 46 of the upper section 20 could be latched behind the latches 36 on the lower section 22, or behind a portion of the latches 36 on the lower section 22. The latches 36 also continue to prevent the lower section 22 from pivoting into the crate 10. With the front wall 18 in the retracted position, the label surface 48 is displayed on the exterior of the crate 10.

Figure 6:
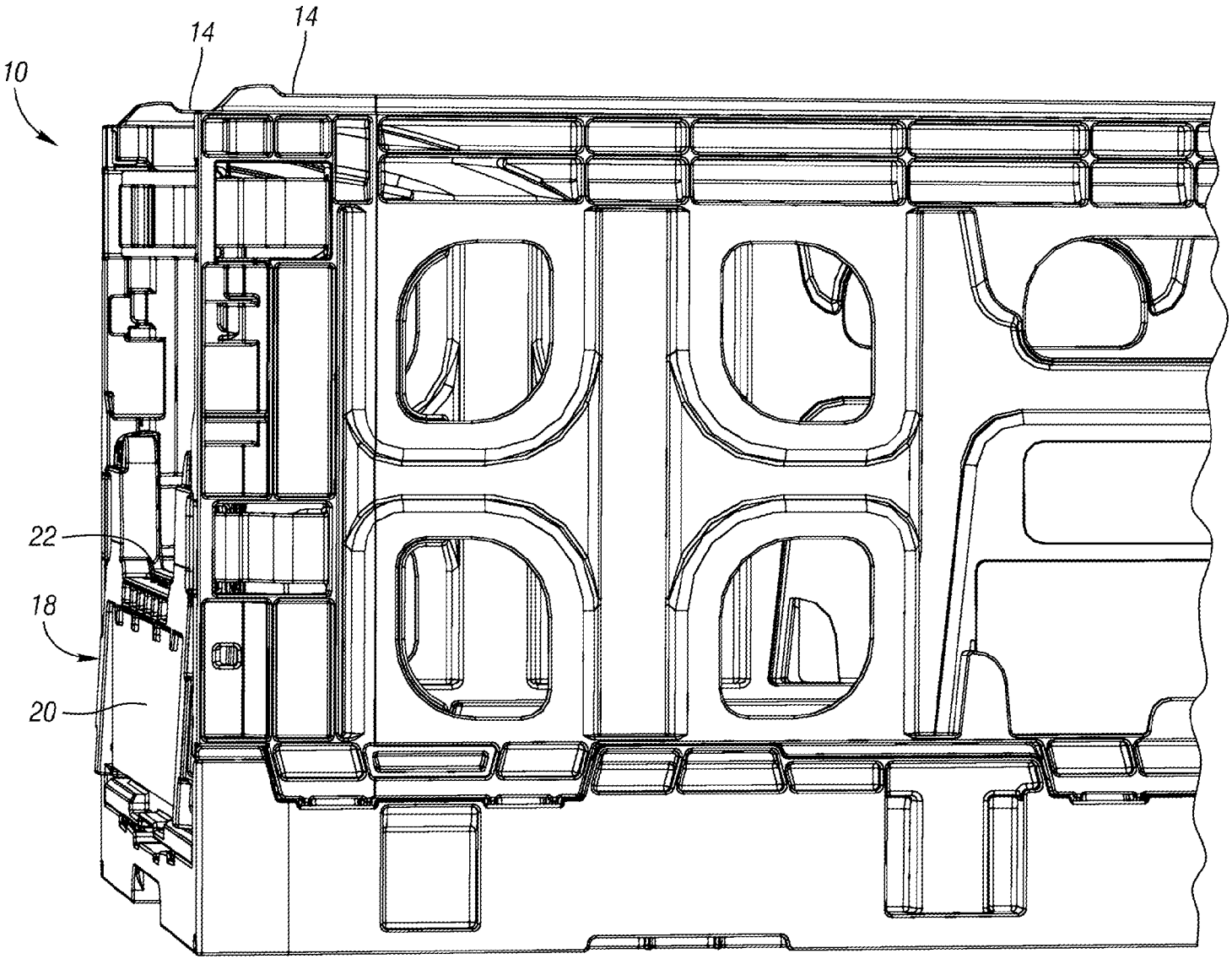
FIG. 6 is a side perspective of the front of the crate of FIG. 5.

As shown in FIG. 6, the partial nesting of the upper section 20 into the lower section 22 provides a substantially non-protruding front wall 18 when the front wall 18 is in the retracted position, with the upper section 20 positioned adjacent the lower section 22.

Figure 7:
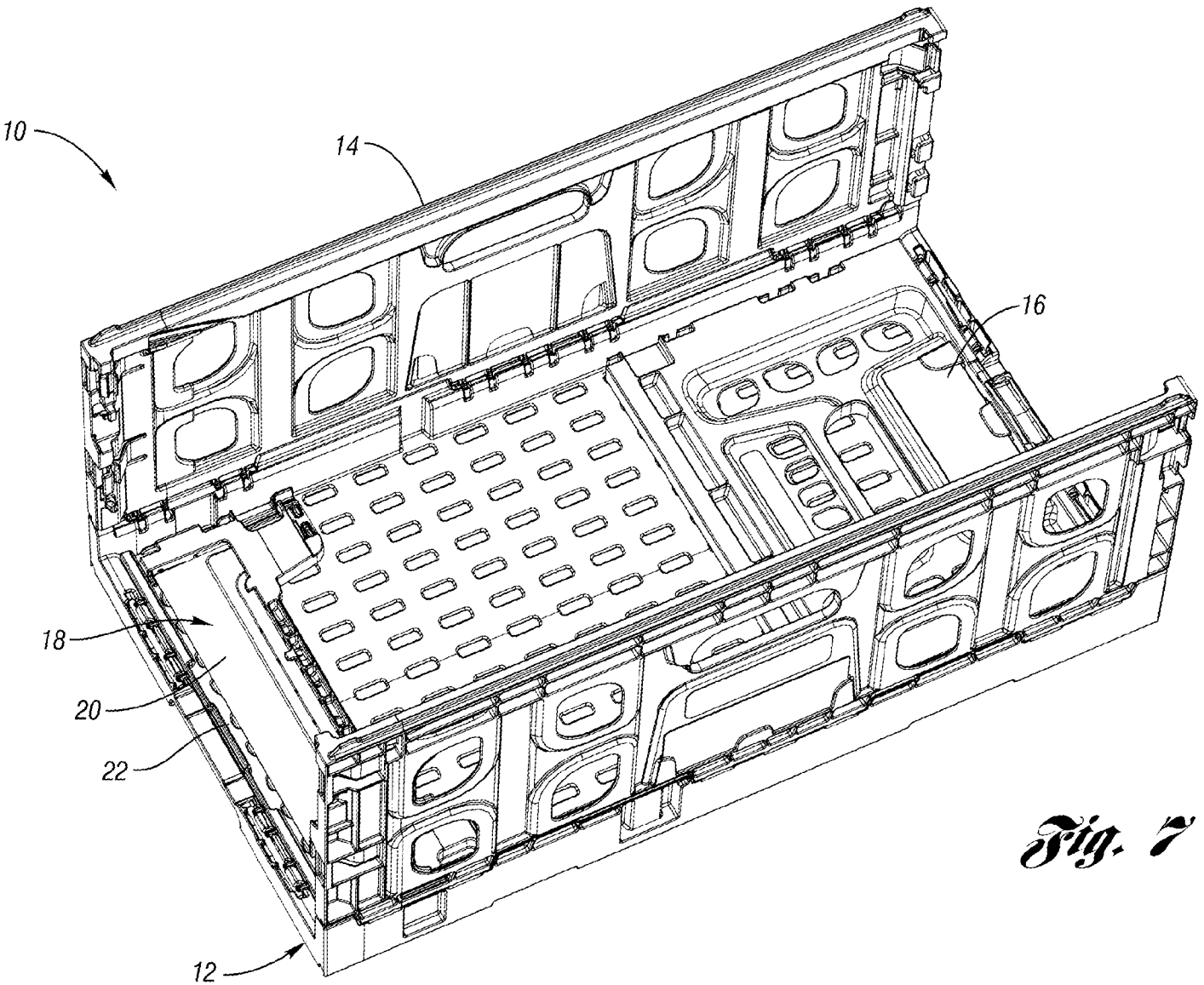
FIG. 7 is a perspective view of the crate of FIG. 1 with the front and rear walls collapsed.
Figure 8:
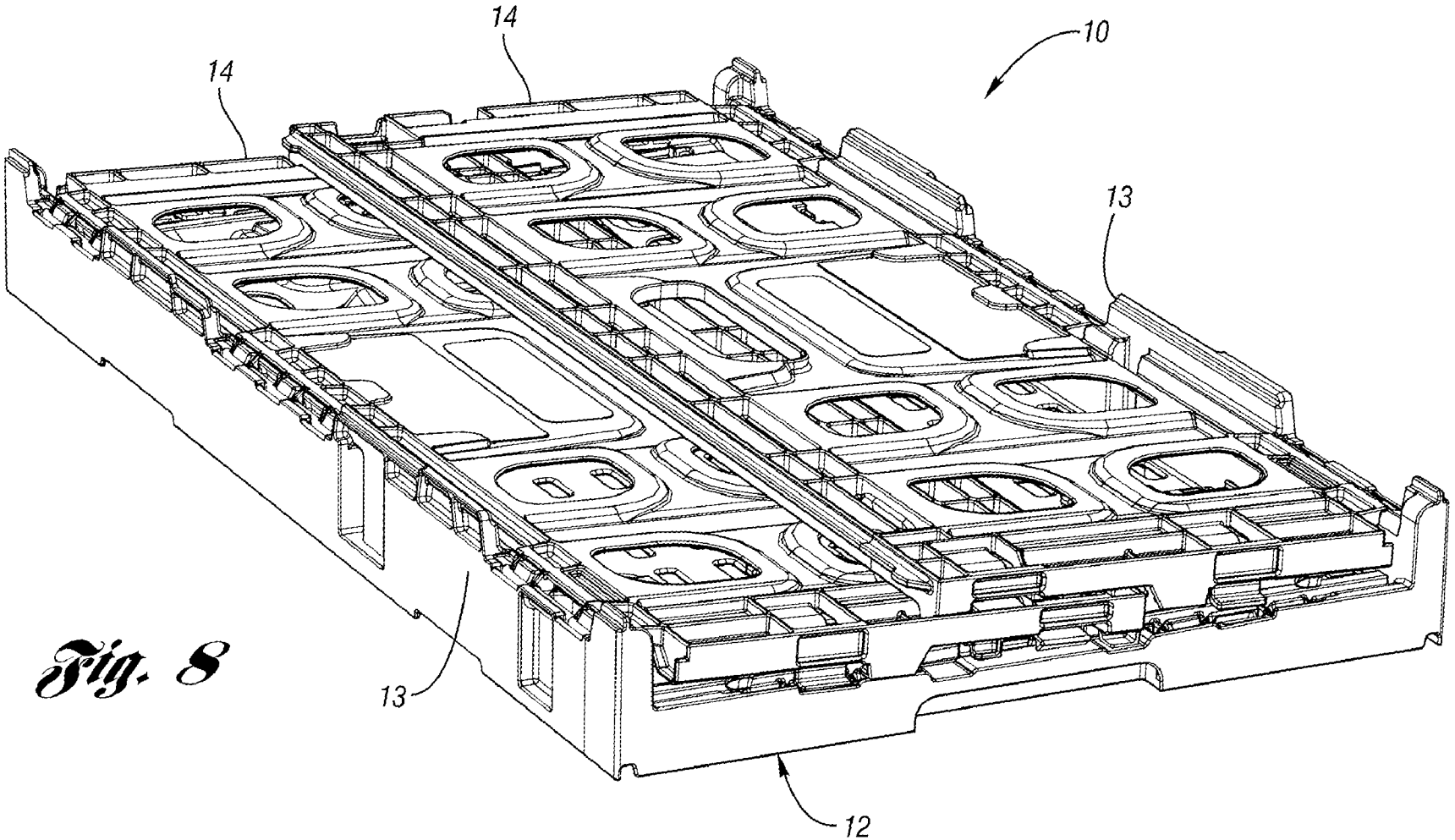
FIG. 8 is a perspective view of the crate of FIG. 1 in a collapsed position.

Referring to FIG. 7, the front wall 10 can be collapsed onto the base 12 from the retracted position (FIG. 6), by releasing the latches 36 (FIG. 5). The side walls 14 are then pivoted onto the front and rear walls 18, 16 as shown in FIG. 8. In the collapsed position, many empty crates 10 can be shipped in a reduced volume.

Figure 9:
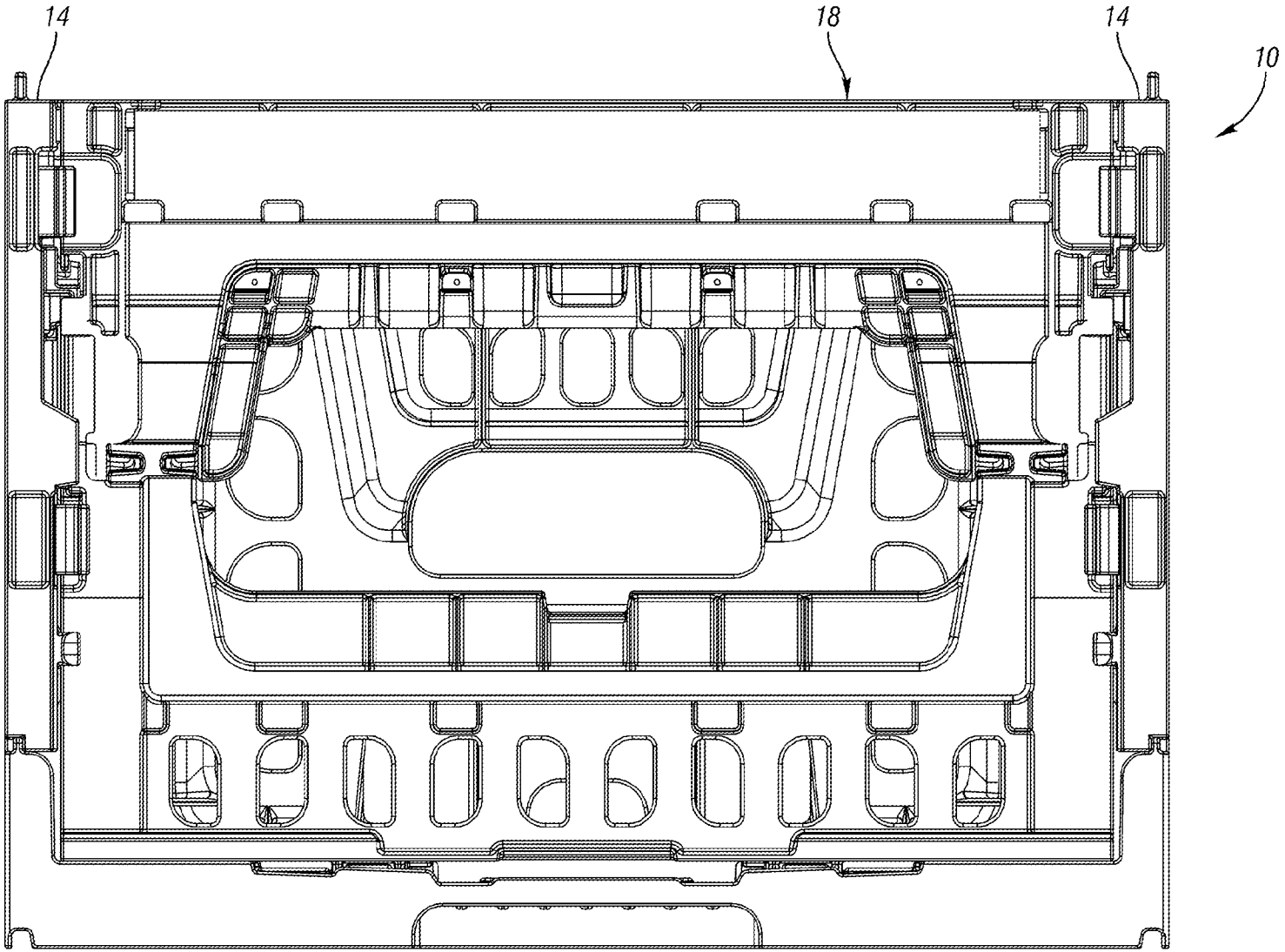
FIG. 9 is a front view of the crate of FIG. 1.
Figure 10:
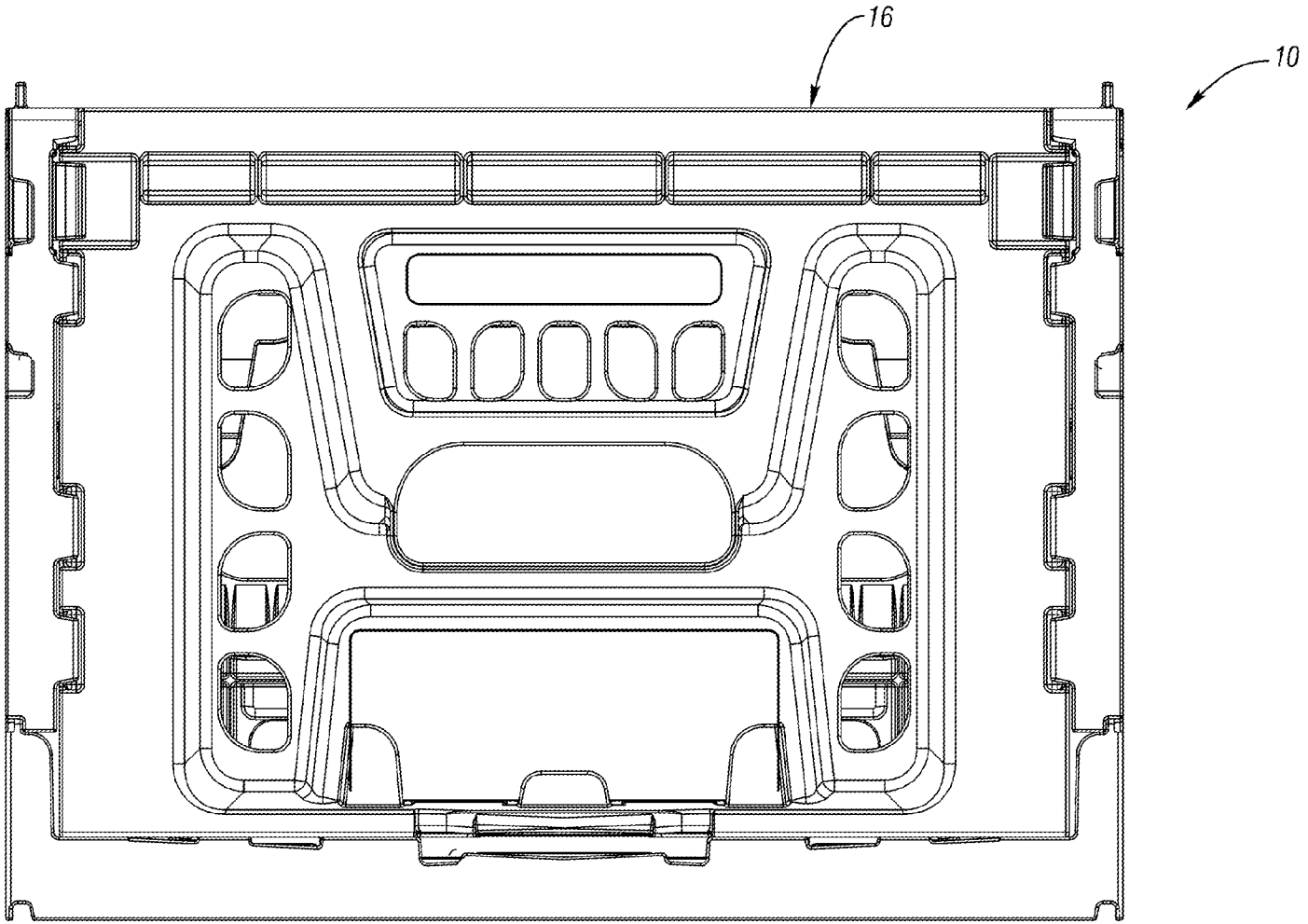
FIG. 10 is a rear view of the crate of FIG. 1.
Figure 11:
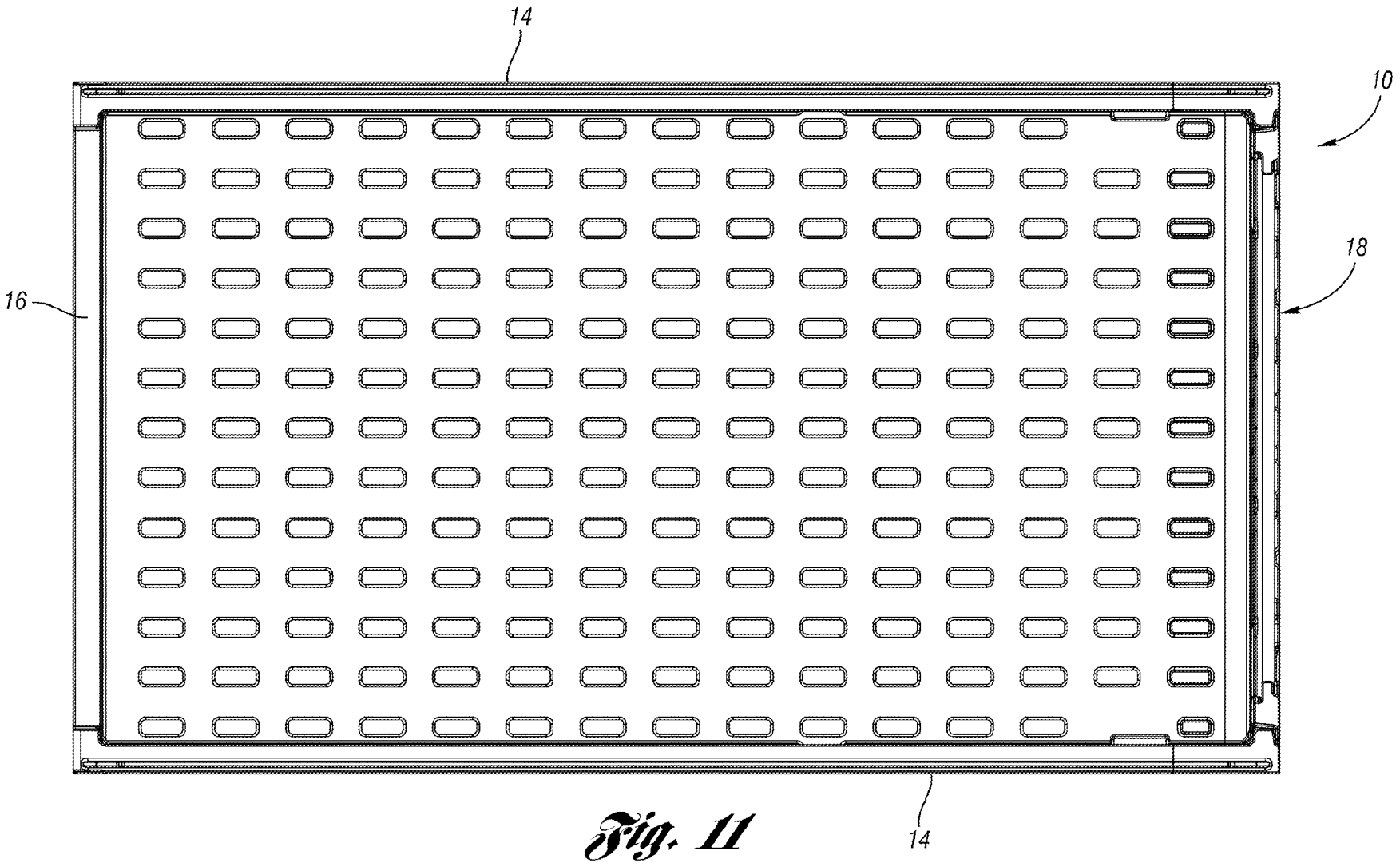
FIG. 11 is a top view of the crate of FIG. 1.
Figure 12:
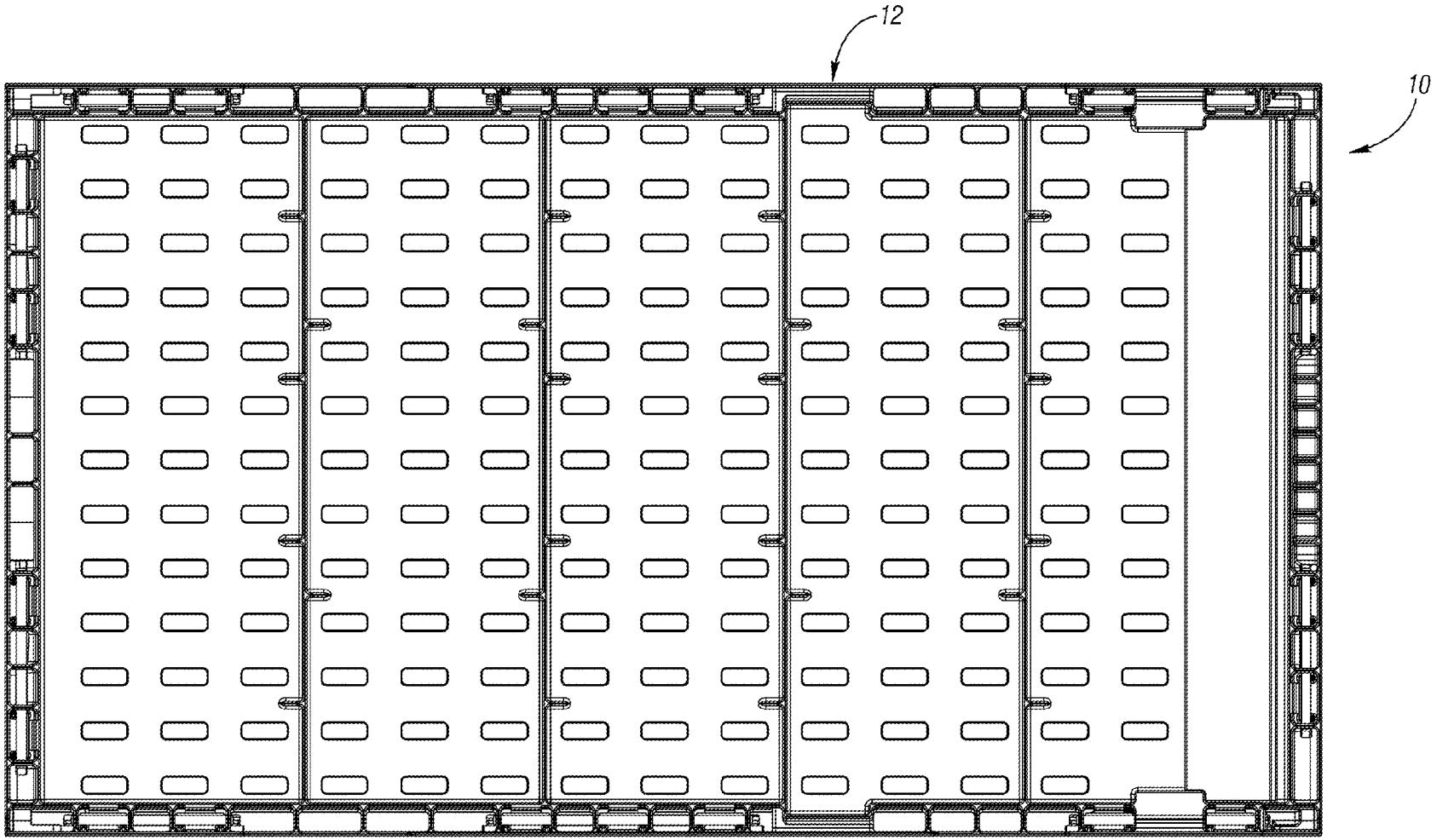
FIG. 12 is a bottom view of the crate of FIG. 1.
Figure 13:
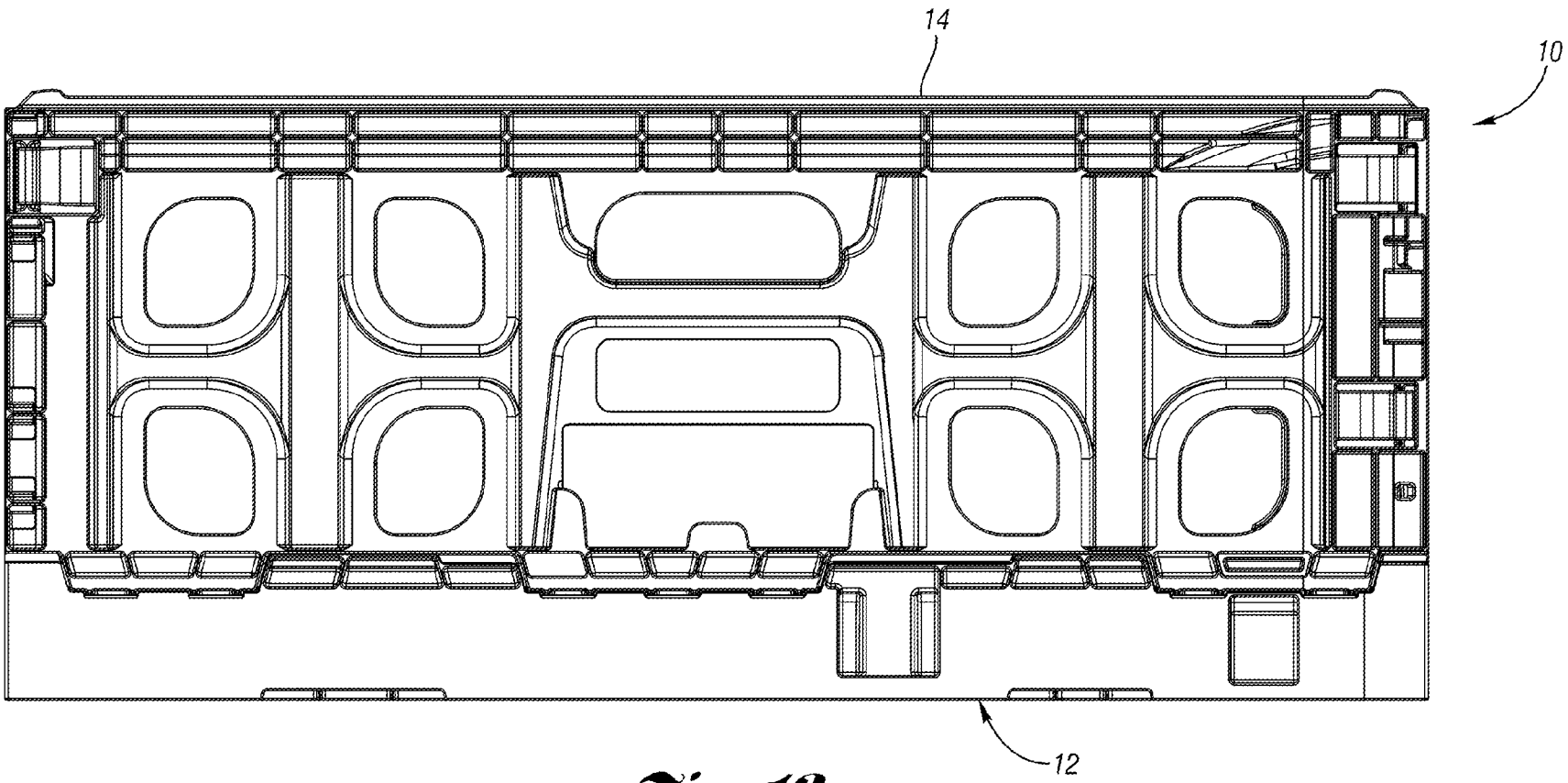
FIG. 13 is a side view of the crate of FIG. 1.

FIG. 9 is a front view of the crate 10. FIG. 10 is a rear view of the crate 10. FIG. 11 is a top view of the crate 10. FIG. 12 is a bottom view of the crate 10. FIG. 13 is a side view of the crate 10.

In use, egg cartons (or other items) would be shipped to a store in the crate 10 with the front wall 18 closed (FIG. 1). At the store, the front wall 18 would be collapsed (FIG. 5) to provide access to the egg cartons in the interior of the crate 10 by customers or by store workers. When empty, the front wall 18, the side walls 14 and rear wall 16 are collapsed onto the base 12 as shown in FIG. 8 so that the crates 10 occupy less volume and can be efficiently returned to be reused in shipping additional egg cartons (or other items). In the example design illustrated and described above, the upper latches 34 prevent the upper section 20 from pivoting into the crate 10. Thus, the front wall 18 cannot collapse onto the base 12 unless the front wall 18 is retracted, with the upper section 20 in front of the lower section 22. If desired, an alternate upper latch 34 could be provided to permit the front wall 18 to collapse when the upper section 20 is in the closed position.

Figure 14:
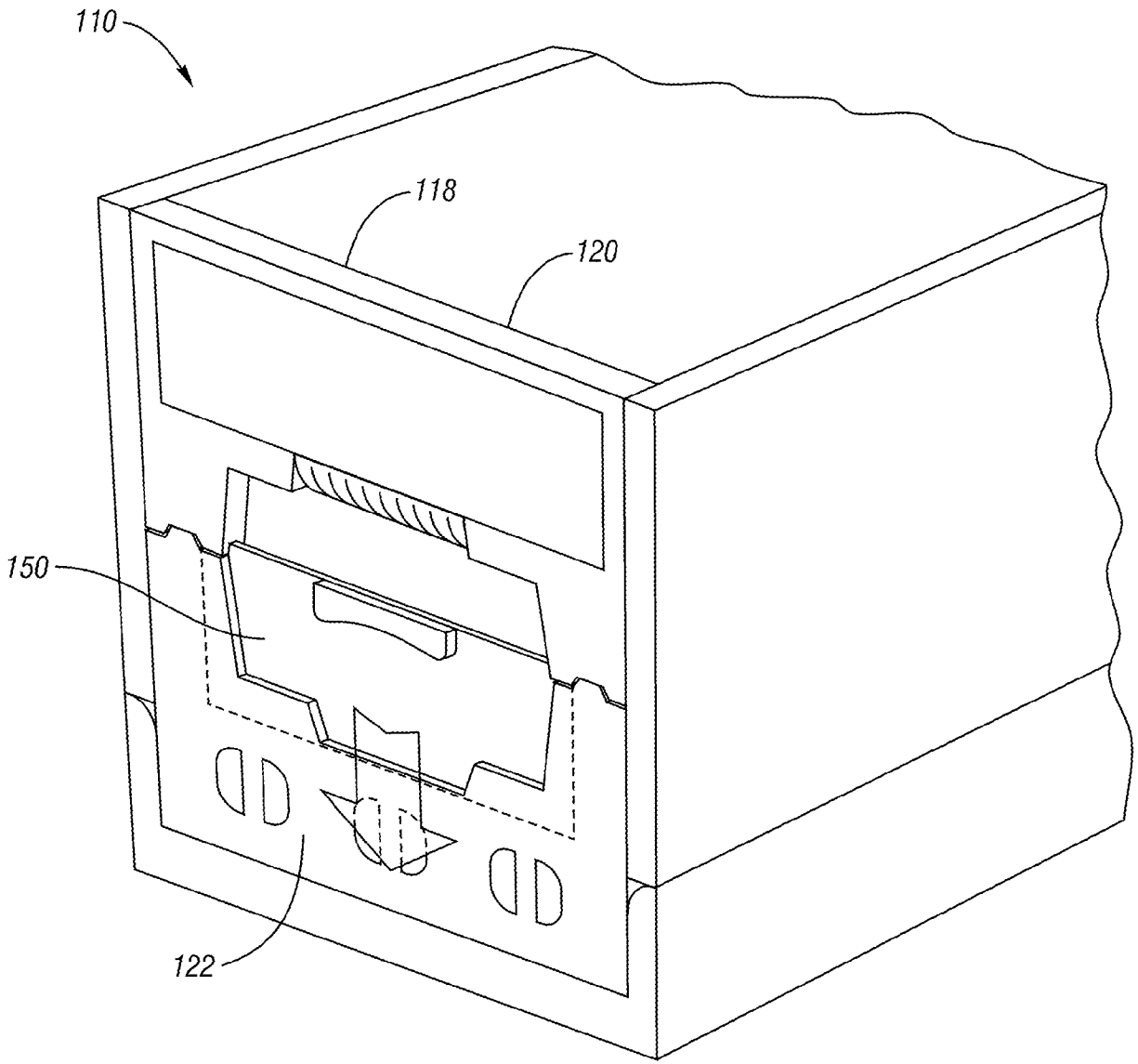
FIG. 14 is a perspective view of an alternate front wall of an alternate crate according to the present invention.

FIG. 14 is a largely schematic perspective view of an alternate front wall 118 of an alternate crate 110 according to the present invention. The front wall 118 includes an upper section 120 pivotably connected to a lower section 122 (latches and other details as in the first embodiment would be included, but are not shown for simplicity). The only difference in the second embodiment is the addition of a sliding door 150 that is slidably mounted in the lower section 122. The sliding door 150 can be closed (as illustrated) during shipping to increase the protection of the egg crates (or other items) inside the crate 110. The sliding door 150 would be slid into the lower section 122 for access to the interior of the crate 110, either before or after the upper section 120 is pivoted downward to the retracted position. The sliding door 150 could be incorporated into the crate 10 of FIGS. 1-13.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A container comprising:

a base;

a plurality of walls extending upward from the base, the plurality of walls including a first wall, the first wall including an upper section and a lower section, the upper section including a pair of upper arms pivotable relative to the lower section, an upper opening defined between the pair of upper arms, the lower section including a pair of lower arms pivotably connected to the upper arms, a lower opening defined between the lower arms, wherein the upper section is pivotable relative to the lower section to a retracted position adjacent the lower section, such that the upper opening and the lower opening are at least substantially aligned to provide access to an interior of the container; and an upper latch selectively permitting and preventing the upper section from pivoting relative to the lower section.

2. The container of claim 1 wherein one of the upper section and the lower section includes a plurality of projections received in recesses of the other of the upper section and the lower section when the upper section is pivoted to the retracted position.

3. The container of claim 1 wherein the lower section is pivotably connected to the base.

4. The container of claim 3 wherein the lower section and the upper section can be pivoted onto the base when the upper section is in the retracted position.

5. The container of claim 1 wherein the plurality of walls are movable between an upright position and a collapsed position.

6. The container of claim 1 wherein the upper latch prevents the upper section from pivoting into the container.

7. The container of claim 6 wherein the upper latch is manually actuatable from an exterior of the container.

8. The container of claim 1 further including a lower latch selectively preventing and permitting the lower section to pivot into the container.

9. The container of claim 8 wherein the lower latch is manually actuatable from an exterior of the container.

10. The container of claim 9 wherein the upper latch is manually actuatable from an exterior of the container.

11. A container comprising:

a base;

a plurality of walls extending upward from the base, the plurality of walls including a first wall, the first wall including a plurality of sections including a first section and a second section, the first section pivotable to a retracted position adjacent the second section, the first section including a first opening, the second section including a second opening, wherein the first opening is at least substantially aligned with the second opening when the first section is pivoted to the retracted position and wherein both the first opening and the second opening are oriented to open upwardly when the first section is pivoted to the refracted position; and at least one latch connecting the second section to adjacent ones of the plurality of walls.

12. The container of claim 11 wherein the second section is pivotably connected to the base.

13. The container of claim 11 wherein one of the first section and the second section includes a plurality of projections received in recesses of the other of the first section and the second section when the first section is pivoted to the retracted position.

14. The container of claim 11 wherein the first section and the second section can be pivoted onto the base when the first section is in the retracted position.

15. The container of claim 11 further including at least one latch connecting the first section to adjacent ones of the plurality of walls.

16. The container of claim 11 wherein the at least one latch is at least one second latch, the container further including at least one first latch selectively permitting and preventing the first section from pivoting relative to the second section.

17. A container comprising:

a base; and a plurality of walls extending upward from the base including a first wall, the first wall including an upper section and a lower section, the upper section pivotable between a closed position above the lower section and a retracted position adjacent the lower section, the lower section having an upper edge having a mid-portion contoured downwardly to provide access to an interior of the container when the upper section is in the retracted position, wherein the upper section is selectively secured in the retracted position to the lower section.

18. The container of claim 17 wherein the upper section has a lower edge having a mid-portion contoured upwardly when the upper section is in the closed position.

19. The container of claim 17 wherein the upper section is pivotably connected to the lower section.

20. The container of claim 17 wherein the lower section is pivotably connected to the base.

21. The container of claim 17 wherein the plurality of walls are collapsible onto the base.

22. The container of claim 17 further including an upper latch selectively permitting and preventing the upper section from pivoting relative to the lower section.

23. The container of claim 17 further including a lower latch selectively preventing and permitting the lower section to pivot into the container.

24. A container comprising:

a base;

a plurality of walls extending upward from the base including a first wall, the first wall including an upper section and a lower section, the upper section pivotable between a closed position above the lower section and a retracted position adjacent the lower section, the upper section and the lower section having adjacent edges when the upper section is in the closed position, at least one of the adjacent edges contoured away from the other adjacent edge when the upper section is in the closed position; and at least one stop preventing the lower section from pivoting outwardly of the container.

25. The container of claim 24 wherein the upper section is pivotably connected to the lower section.

26. The container of claim 24 wherein the lower section is pivotably connected to the base.

27. The container of claim 24 wherein the plurality of walls are collapsible onto the base.

28. A method of using a container including the steps of:

a) pivoting an upper section of a first wall of a plurality of walls downward to a refracted position adjacent a lower section of the first wall, such that a plurality of protrusions on the upper section are received in recesses in the lower section; and b) after said step a), pivoting the first wall with the upper section in the retracted position into the container to a collapsed position.

29. The method of claim 28 wherein the upper section must be pivoted to the retracted position before the first wall can be pivoted into the container.

30. The method of claim 29 wherein the upper section is in front of the lower section when the upper section is in the retracted position and wherein the upper section is above the lower section when the upper section is in a closed position.

* * * * *